US009031835B2

(12) United States Patent
Grancharov et al.

(10) Patent No.: US 9,031,835 B2
(45) Date of Patent: May 12, 2015

(54) METHODS AND ARRANGEMENTS FOR LOUDNESS AND SHARPNESS COMPENSATION IN AUDIO CODECS

(75) Inventors: Volodya Grancharov, Solna (SE); Sigurdur Sverrisson, Kungsängen (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 390 days.

(21) Appl. No.: 13/510,333

(22) PCT Filed: Jun. 29, 2010

(86) PCT No.: PCT/SE2010/050746

§ 371 (c)(1),
(2), (4) Date: May 17, 2012

(87) PCT Pub. No.: WO2011/062535

PCT Pub. Date: May 26, 2011

(65) Prior Publication Data

US 2012/0221326 A1 Aug. 30, 2012

Related U.S. Application Data

(60) Provisional application No. 61/262,714, filed on Nov. 19, 2009.

(51) Int. Cl.

| | |
|---|---|
| ***G10L 19/02*** | (2013.01) |
| ***G10L 21/038*** | (2013.01) |
| *G10L 19/26* | (2013.01) |

(52) U.S. Cl.

CPC ..... *G10L 21/038* (2013.01); *G10L 19/265* (2013.01)

(58) Field of Classification Search

CPC ..... G10L 19/00; G10L 19/0019; G10L 19/02; G10L 19/0204; G10L 19/0208; G10L 19/035; G10L 19/06; G10L 19/26; G10L 19/265; G10L 21/00; G10L 21/003; G10L 21/02; G10L 21/0205; G10L 21/0316; G10L 21/034

USPC ..... 704/205, 203, 200, 201, 206, 209, 229

See application file for complete search history.

(56) References Cited

U.S. PATENT DOCUMENTS

| | | | | |
|---|---|---|---|---|
| 6,680,972 | B1 * | 1/2004 | Liljeryd et al. | 375/240 |
| 7,529,660 | B2 | 5/2009 | Bessette et al. | |

(Continued)

FOREIGN PATENT DOCUMENTS

| | | | |
|---|---|---|---|
| EP | 1962282 | A1 | 8/2008 |
| EP | 2104097 | A1 | 9/2009 |

(Continued)

OTHER PUBLICATIONS

Tsujino, K. et al., "Low-Complexity Bandwidth Extension in MDCT Domain For Low-Bitrate Speech Coding", Acoustics, Speech and Signal Processing, ICASSP 2009, pp. 4145-4148.

(Continued)

*Primary Examiner* — Qi Han

(74) *Attorney, Agent, or Firm* — Coats & Bennett, P.L.L.C.

(57) ABSTRACT

In a method of improving perceived loudness and sharpness of a reconstructed speech signal delimited by a predetermined bandwidth, performing the steps of providing (S10) the speech signal, and separating (S20) the provided signal into at least a first and a second signal portion. Subsequently, adapting (S30) the first signal portion to emphasize at least a predetermined frequency or frequency interval within the first bandwidth portion. Finally, reconstructing (S40) the second signal portion based on at least the first signal portion, and combining (S50) the adapted first signal portion and the reconstructed second signal portion to provide a reconstructed speech signal with an overall improved perceived loudness and sharpness.

35 Claims, 11 Drawing Sheets

(56) References Cited

U.S. PATENT DOCUMENTS

| | | | | |
|---|---|---|---|---|
| 7,940,941 | B2 | 5/2011 | Akiyama et al. | |
| 7,999,850 | B2 | 8/2011 | Tashiro | |
| 2002/0138268 | A1* | 9/2002 | Gustafsson | 704/258 |
| 2006/0149532 | A1 | 7/2006 | Boillot et al. | |
| 2007/0033023 | A1* | 2/2007 | Sung et al. | 704/229 |
| 2008/0097751 | A1 | 4/2008 | Tsuchinaga et al. | |
| 2008/0177532 | A1 | 7/2008 | Greiss et al. | |
| 2009/0076829 | A1* | 3/2009 | Ragot et al. | 704/500 |
| 2009/0198498 | A1 | 8/2009 | Ramabadran et al. | |

FOREIGN PATENT DOCUMENTS

| | | | |
|---|---|---|---|
| JP | 200510621 | A | 1/2005 |
| JP | 2007164041 | A | 6/2007 |
| JP | 2007178675 | A | 7/2007 |
| JP | 2008-107415 | A | 5/2008 |
| JP | 201066335 | A | 3/2010 |
| WO | 03102921 | A1 | 12/2003 |
| WO | 2009072777 | A1 | 6/2009 |

OTHER PUBLICATIONS

Berisha, V. et al. "Bandwidth Extension of Audio Based on Partial Loudness Criteria." 2006 IEEE 8th Workshop on Multimedia Signal Processing, MMSP '06, Oct. 3-6, 2006, Victoria, Canada, pp. 146-149.

Fastl, H. and Zwicker, E., Psychoacoustics: Facts and Models. 3rd Edition. Springer, Berlin, Germany. 2007.

ITU-T. Rec. G.729.1. "G.729-based embedded variable bit-rate coder: An 8-32 kbits/s scalable wideband coder bitstream interoperable with G.729." May 2006. International Telecommunication Union, Geneva, Switzerland.

ITU-T. Rec. G.718. "Frame error robust narrowband and wideband embedded variable bit-rate coding of speech and audio from 8-32 kbit/s." 2008. International Telecommunication Union, Geneva, Switzerland.

3GPP. "Technical Specification Group Services and System Aspects; Speech codec speech processing functions; Adaptive Multi-Rate-Wideband (AMR-WB) speech codec; Transcoding functions (Release 8)" 3GPP TS 26.190 V8.0.0. Dec. 2008. 3GPP, Sophia Antipolis, France.

3GPP. "Technical Specification Group Services and System Aspects; Audio codec processing functions; Extended Adaptive Multi-Rate-Wideband (AMR-WB+) codec; Transcoding functions (Release 9)." 3GPP TS 26.290 V9.0.0. Sep. 2009. 3GPP, Sophia Antipolis, France.

3GPP. "Technical Specification Group Services and System Aspects; General audio codec audio processing functions; Enhanced aacPlus general audio codec; Enhanced aacPlus encoder SBR part (Release 8)." 3GPP TS 26.404 V8.0.0. Dec. 2008. 3GPP, Sophia Antipolis, France.

Stoll, G., and Kozamernik, F., "EBU listening tests on internet audio codecs." Jun. 2000. EBU Technical Review. EBU, Geneva, Switzerland.

* cited by examiner

METHODS AND ARRANGEMENTS FOR LOUDNESS AND SHARPNESS COMPENSATION IN AUDIO CODECS

TECHNICAL FIELD

The present invention relates to audio coding/decoding in general and particularly to a bandwidth extension scheme where compensation for loudness and sharpness limitation in audio coding is performed or supported.

BACKGROUND

The field of psychoacoustics refers to the study of the perception of sound. This includes how humans listen, their physiological responses, and the physiological impact of music and sound on the human nervous system. In particular, for the development of modern communication systems the knowledge how acoustic stimuli are processed by the auditory system is important in the development of new digital audio technologies and in the improvement of existing technologies. Audio codecs, which are essential components in multimedia and broadcast services depend on the knowledge of the characteristics of the human auditory system to compress audio information for efficient transmission and storage at low bit rates. In addition, objective schemes for quality measurement, which also depend heavily on psychoacoustic knowledge, have been developed to simulate subjective ratings of audio quality.

Almost all modern audio codecs [1-5] exploit the concept of encoding and transmitting only part of the signal frequency components of an audio signal, and reconstructing the remaining frequencies of the audio signal at the decoder. Typically, only the low frequency bands (LB) of a signal are transmitted, and the high frequency bands (HB) of the signal are subsequently reconstructed by means of so-called bandwidth extension (BWE). In a typical BWE scheme, the frequency content of a signal is extended by translating or flipping the available frequency components from a neighbouring band (usually the available LB). However, a signal reconstructed in such a manner does not have a HB that match exactly the HB of the original audio signal, due to certain artifacts that can be perceived in the reconstructed signal. To minimize the impact of these artifacts, in a BWE scheme, the gain of reconstructed HB is typically kept below the original HB gain, which leads to a reconstructed signal with modified psychoacoustic properties. Among the most affected properties are the sensation of loudness, and sensation of sharpness. Loudness is related to the signal intensity or sound pressure of the speech signal. Sharpness is related to the energy distribution over frequency of the speech signal and increase with the relative increase of high-frequency components. When the signal is band-limited or a conventional BWE scheme is applied, both the perceived loudness and sharpness of the reconstructed signal decrease in comparison to the original signal, which leads to drop in subjective quality.

Therefore there is a need for methods and arrangements enabling improving the perceived loudness and sharpness of a received/decoded signal.

SUMMARY

The present invention relates to an improved bandwidth extension scheme.

An object of the present invention is to provide a methods and system for improving perceived quality of a speech signal.

A further object is to enable improvements of perceived loudness and sharpness of a reconstructed speech signal.

A specific object is to provide encoder and decoder arrangements for processing a speech signal.

Another specific object is to provide methods of processing a speech signal.

Yet a further specific object is to provide a filter arrangement.

In a first aspect of improving perceived loudness and sharpness of a reconstructed speech signal delimited by a predetermined bandwidth, the speech signal is provided. Subsequently, the speech signal is separated into at least a first signal portion based on a first bandwidth portion of the predetermined bandwidth and a second signal portion based on a second bandwidth portion of the predetermined bandwidth. Subsequently, the first signal portion is adapted to emphasize at least a predetermined frequency or frequency interval within the first bandwidth portion. Finally, the second signal portion is reconstructed based on at least the first signal portion, and the adapted first signal portion and the reconstructed second signal portion are combined to provide a reconstructed speech signal with an overall improved perceived loudness and sharpness.

In a second aspect of the present disclosure, a system for improving perceived loudness and sharpness of a reconstructed speech signal delimited by a predetermined bandwidth comprises means configured for providing the speech signal. In addition means configured for separating the speech signal into at least a first signal portion based on a first bandwidth portion of the predetermined bandwidth and a second signal portion based on a second bandwidth portion of the predetermined bandwidth, are provided in the system. In addition, the system comprises means configured for adapting the first signal portion to emphasize at least a predetermined frequency or frequency interval within the first bandwidth portion. Finally, the system comprises means configured for reconstructing the second signal portion based on at least the first signal portion, and means configured for combining the adapted first signal portion and the reconstructed second signal portion to provide a reconstructed speech signal with an overall improved perceived loudness and sharpness.

In a third aspect of the present disclosure, an encoder arrangement for processing a speech signal delimited by a predetermined bandwidth in a communication system comprises means configured for providing the speech signal. Further, the encoder arrangement comprises means configured for separating the speech signal into at least a first signal portion based on a first bandwidth portion of the predetermined bandwidth, and a second signal portion based on a second bandwidth portion of the predetermined bandwidth. In addition, the encoder arrangement comprises means configured for adapting the first signal portion to emphasize at least a predetermined frequency or frequency interval within the first bandwidth portion, and means configured for transmitting at least the adapted first signal portion to another node.

In a fourth aspect of the present disclosure, a decoder arrangement for processing a speech signal delimited by a predetermined bandwidth in a communication system includes means configured for receiving an adapted first signal portion of the speech signal. The adapted first signal portion originates from separating a provided speech signal into at least a first signal portion based on a first bandwidth portion of the predetermined bandwidth and a second signal portion based on a second bandwidth portion of the predetermined bandwidth, and finally adapting the first signal portion to emphasize at least a predetermined frequency or frequency interval within the first bandwidth portion. In addition, the decoder arrangement includes means configured for reconstructing the second signal portion based on at least the received adapted first signal portion. Finally, the decoder arrangement includes means configured for combining the received adapted first signal portion and the reconstructed second signal portion to provide a reconstructed speech signal with an overall improved perceived loudness and sharpness.

In a fifth aspect of the present disclosure, a decoder arrangement for processing a speech signal delimited by a predetermined bandwidth in a communication system includes means configured for receiving a first signal portion of the speech signal. The first signal portion originates from separating a provided speech signal into at least a first signal portion based on a first bandwidth portion of the predetermined bandwidth and a second signal portion based on a second bandwidth portion of the predetermined bandwidth. Further, the decoder arrangement includes means configured for adapting the received first signal portion to emphasize at least a predetermined frequency or frequency interval within the first bandwidth portion. Finally, the decoder arrangement includes means configured for reconstructing the second signal portion based on at least the first signal portion, and means configured for combining the adapted first signal portion and the reconstructed second signal portion to provide a reconstructed speech signal with an overall improved perceived loudness and sharpness.

In a sixth aspect of the present disclosure, a method of processing a speech signal delimited by a predetermined bandwidth in an encoder arrangement in a node in a communication system, includes providing the speech signal and separating the speech signal into at least a first signal portion based on a first bandwidth portion of the predetermined bandwidth, and a second signal portion based on a second bandwidth portion of the predetermined bandwidth. In addition, the method includes adapting the first signal portion to emphasize at least a predetermined frequency or frequency interval within the first bandwidth portion, and transmitting at least the adapted first signal portion to another node.

In a seventh aspect of the present disclosure, a method of processing a speech signal delimited by a predetermined bandwidth in a decoder arrangement in a node in a communication system, includes receiving an adapted first signal portion from another node. The adapted first signal portion originates from separating a provided speech signal into at least a first signal portion based on a first bandwidth portion of the predetermined bandwidth and a second signal portion based on a second bandwidth portion of the predetermined bandwidth, and adapting the first signal portion to emphasize at least a predetermined frequency or frequency interval within the first bandwidth portion. Further, the method includes reconstructing the second signal portion based on the received adapted first signal portion, and combining the adapted first signal portion and the reconstructed second signal portion to provide a reconstructed speech signal with an overall improved perceived loudness and sharpness.

In an eighth aspect of the present disclosure, a method of processing a speech signal delimited by a predetermined bandwidth in a decoder arrangement in a node in a communication system, includes receiving, from another node, a first signal portion of the speech signal. The first signal portion originates from separating the speech signal into at least a first signal portion based on a first bandwidth portion of the predetermined bandwidth and a second signal portion based on a second bandwidth portion of the predetermined bandwidth. Further, the method includes adapting the received first signal portion to emphasize at least a predetermined frequency or frequency interval within the first bandwidth portion, and reconstructing the second signal portion based on at least the first signal portion. Finally, the method includes combining the adapted first signal portion and the reconstructed second signal portion to provide a reconstructed speech signal with an overall improved perceived loudness and sharpness.

In a ninth aspect of the present disclosure, a filter arrangement for adapting a speech signal delimited by a predetermined bandwidth in a communication system is configured for adapting a provided first signal portion of a speech signal, the first signal portion being based on a first bandwidth portion of the predetermined bandwidth of the speech signal, to emphasize at least a predetermined frequency interval within the first bandwidth portion.

Advantages of the present invention includes improving the overall perceived loudness and sharpness of a reconstructed speech signal by pre-filtering part of the speech signal.

BRIEF DESCRIPTION OF THE DRAWINGS

The invention, together with further objects and advantages thereof, may best be understood by referring to the following description taken together with the accompanying drawings, in which.

DETAILED DESCRIPTION

The present disclosure relates to speech encoding/decoding in communication systems, such as systems utilizing bandwidth extension schemes and methods and arrangements for improving the perceived quality in such systems, specifically for improving perceived loudness and sharpness. An example of a particular codec that would benefit from the embodiments of the present invention is the AMR-WB codec (Adaptive Multi-Rate WideBand). However, also other codecs utilizing bandwidth extension would benefit from the invention or embodiments thereof.

An aim of the present disclosure is to provide methods and arrangements for adapting a speech signal to improve the perceived loudness and sharpness of the signal e.g. the reconstructed signal. It has been recognized that it is possible to adapt or pre-filter only a selected part of the signal such that the perceived quality of the entire signal is improved. By taking the natural response of the human ear into consideration, it is possible to enhance a speech signal for those frequencies to which the ear is typically most sensitive. Consequently, the listener is tricked into perceiving the entire recombined or reconstructed speech signal as having an improved loudness and sharpness.

Figure 1:
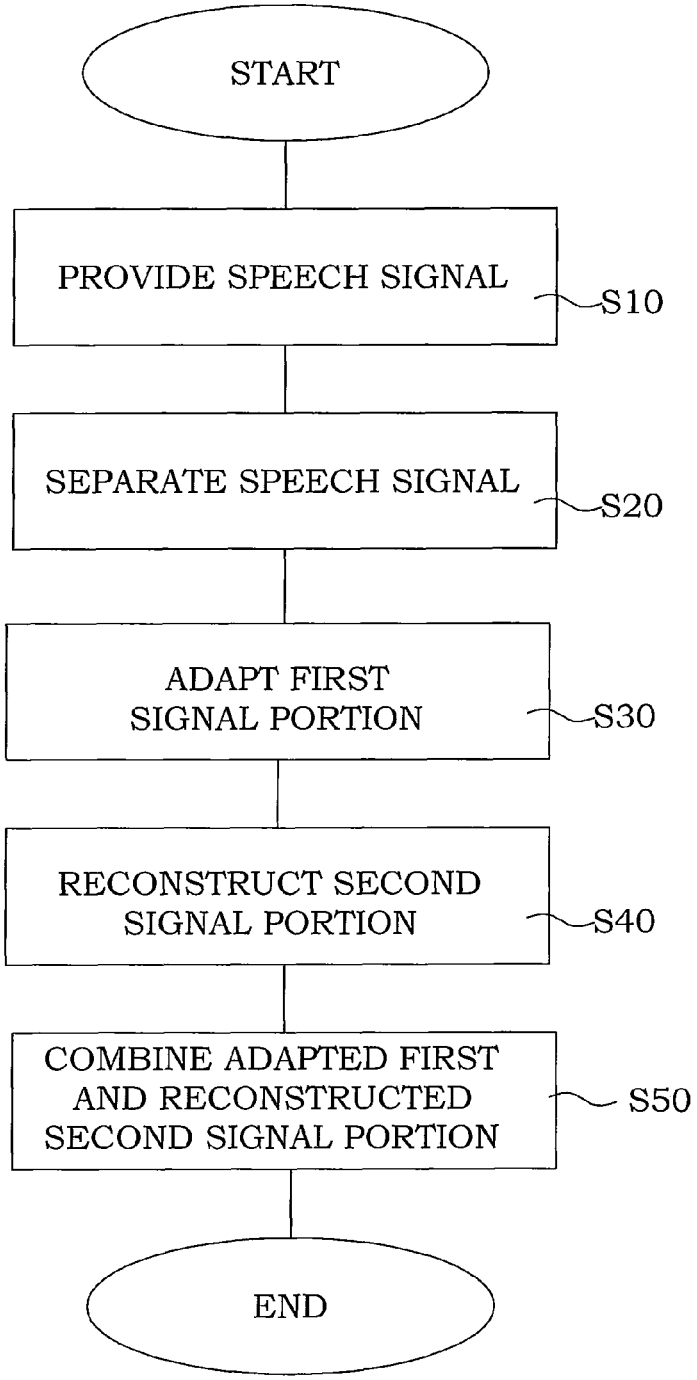
FIG. 1 is a schematic flow chart of an embodiment of a method according to the present invention.

With reference to FIG. 1, an embodiment of a method of improving the perceived loudness and sharpness of a speech signal, the speech signal corresponding to a natural speech signal delimited by a predetermined bandwidth of the present invention will be described. In this embodiment, the method according to the invention is not limited to a particular node or network device.

Initially, a speech signal is provided S10. The speech signal can be provided by any conventional means. Subsequently, the speech signal is separated S20 into at least a first and a second signal portion based on a first and second bandwidth portion of the predetermined bandwidth respectively. Typically, this is performed by dividing the predetermined frequency bandwidth into a low frequency band portion (LB) and a high frequency band portion (HB). However, it is possible to perform other separation of the bandwidth as well. For a particular example of the present invention, the predetermined bandwidth corresponds to a frequency interval of 0-8.0 kHz, where the low frequency bands are represented by frequencies from 0-6.4 kHz, whereas the high frequency bands are represented by frequencies from 6.4 to 8.0 kHz. However, other frequency intervals are equally possible. Subsequently, the first signal portion is adapted S30 to emphasize at least a predetermined frequency or frequency interval within the first bandwidth portion. For a particular example, this predetermined frequency is represented by the centre frequency of the inner ear response, e.g. 3.2 kHz, or the entire frequency range from 3.2 to 6.4 kHz. Finally, the second signal portion or a representation thereof is reconstructed S40 based on the first signal portion, and subsequently the adapted first signal portion and the reconstructed second signal portion are combined S50 to provide a reconstructed speech signal with an overall improved perceived loudness and sharpness.

By way of example, the adaptation of the first portion of the separated speech signal is performed in such a manner that at least part of the energy of the first signal portion is distributed towards a selected frequency within the first bandwidth portion and simultaneously another part of the energy of the first signal portion is distributed towards a high frequency interval or region of the first bandwidth portion. In this manner the overall perceived loudness and sharpness of the subsequently reconstructed signal will be improved as compared to a speech signal reconstructed based on the unfiltered or unadapted low frequency band of the speech signal.

Improved BWE may be achieved by pre-filtering the available low frequency bands (LB) of a speech signal in such a way that the overall loudness and sharpness of the reconstructed signal are compensated for any loss due to BWE scheme. The pre-filtering is typically not performed on the reconstructed high frequency bands (HB), as this will increase the amount of introduced signal artifacts. The term pre-filtering is used to refer to the fact that the disclosed filtering or adaptation is performed prior to reconstructing or recombining the signal. Consequently, the filtering or adaptation is preferably only applied to part of the signal, but the impact or improvement is perceived for the entire recombined or reconstructed signal.

The adapting step S30 is typically based on pre-filtering the low frequency bands and the reconstructing step S40 may be based on BWE or low-pass filtering.

In the following description, the functional steps will be described as distributed or shared between two nodes in a network, e.g. encoder and decoder in a respective transmitter and receiver node in the communication system or network. Consequently, the step of adaptation S30 or filtering the separated or selected first signal portion can be performed after or before transmitting the first signal portion or representation of the first signal portion, details of which will be described in the following.

Figure 2:
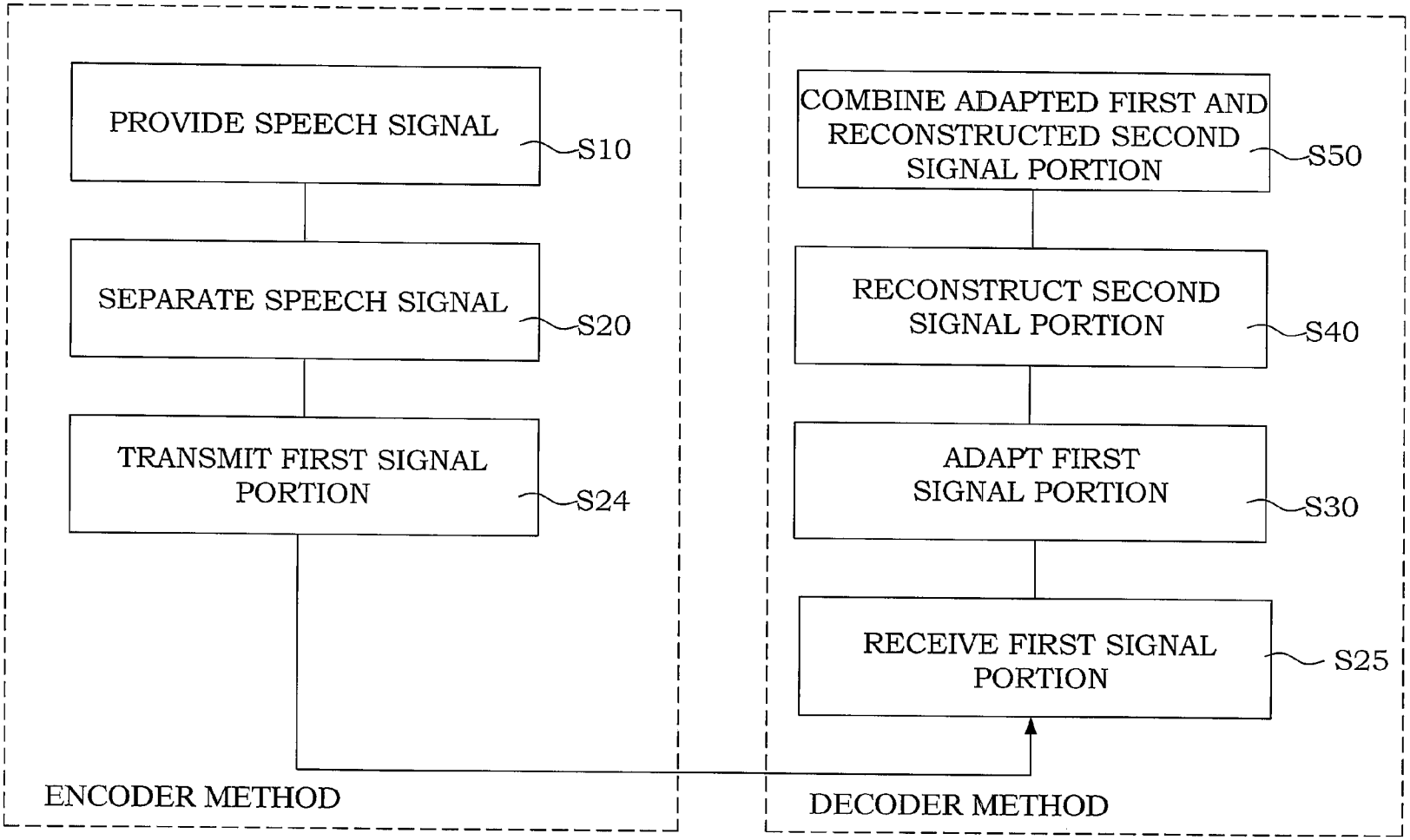
FIG. 2 is a schematic flow chart of a further embodiment of a method according to the present invention.

With reference to FIG. 2, an embodiment of a method where the filtering or adaptation of the first signal portion e.g. of the low frequency bands, of the speech signal is performed in a decoder or receiver arrangement in a first network node will be described. Consequently, some of the various steps of the overall procedure will be executed at an encoder or transmitter arrangement and some will be executed at a decoder or receiver arrangement. In this particular embodiment, a speech signal is encoded in a known manner. Consequently, the steps of providing S10 a speech signal, and separating S20 the speech signal into at least a first and a second signal portion based on a first and second bandwidth portion of a predetermined bandwidth of the speech signal, are preferably performed in an encoder. The separated or selected first signal portion or a representation thereof is then transmitted S24 to and received S25 at a receiver or decoder arrangement in a second node in the network. Subsequently, the decoder adapts S30 the received first signal portion or representation thereof to emphasize a predetermined frequency or frequency interval within the first bandwidth portion. According to known measures, the second signal portion or high frequency bands of the speech signal is reconstructed S40 based on the received first signal portion. Finally, the adapted first signal portion and the reconstructed second signal portion are combined S50 to provide a reconstructed speech signal with overall improved perceived loudness and sharpness.

Figure 3:
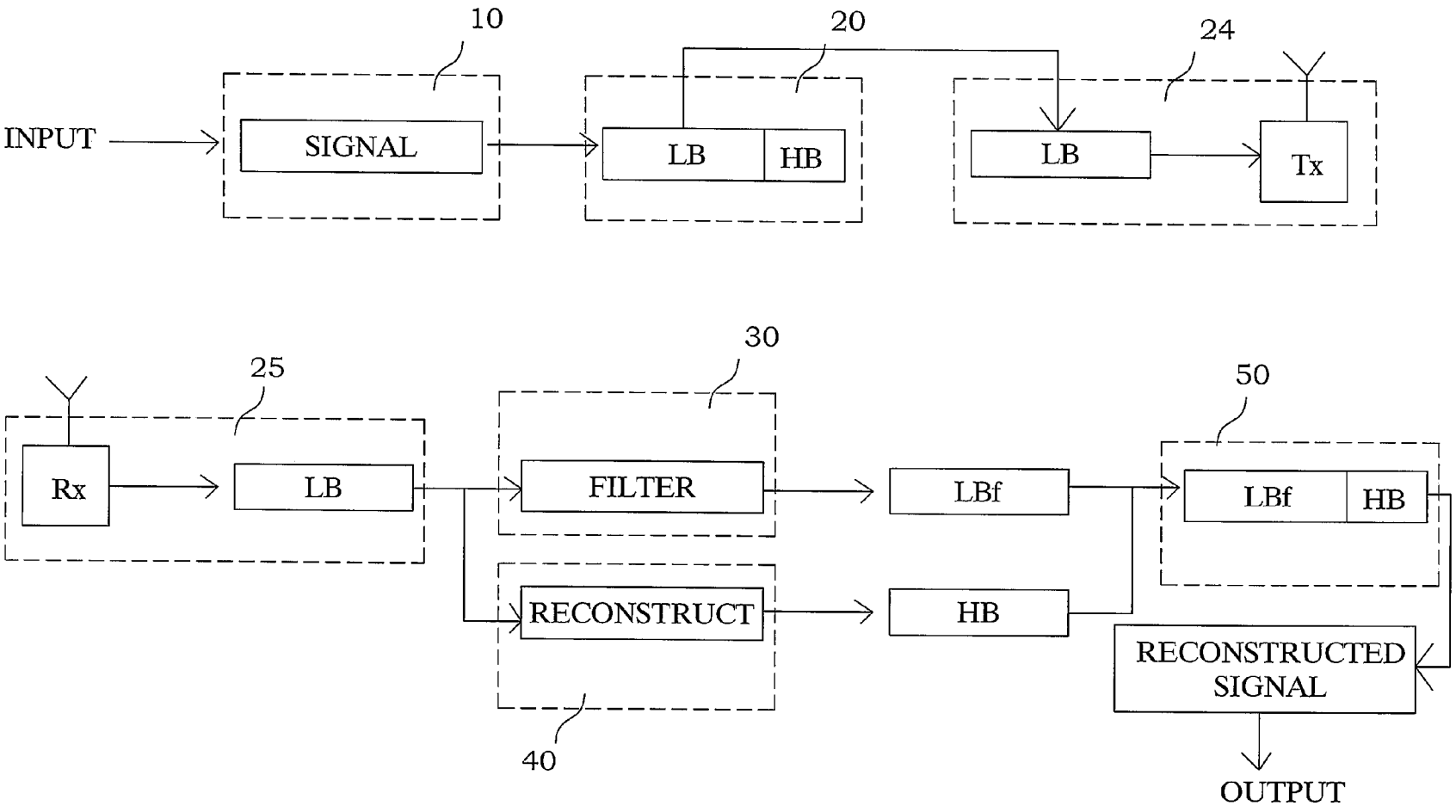
FIG. 3 is a schematic block scheme of the workings of the embodiment of FIG. 2.

With reference to FIG. 3, the various portions of the provided speech signal and their processing during the execution of the described method are shown. Consequently, in FIG. 3*a* speech signal for audio speech processing is provided in a suitable form by a signal provider 10. The signal is subsequently separated by signal separator 20 into a first and second signal portion based on its low frequency bands LB and high frequency bands HB. The first signal portion LB is then transmitted by a transmitter 24. Subsequently, the transmitted first signal portion LB is received at a receiver 25. Based on the received first signal portion LB, the second signal portion HB or representation thereof is reconstructed by reconstructor 40 (e.g. preferably using BWE) and the first signal portion is adapted or filtered by adaptor 30 to provide a filtered or adapted first signal portion $LB_f$. Finally, the two portions $LB_f$ and HB are recombined by combiner 50 to form the improved reconstructed or recombined speech signal.

Figure 4:
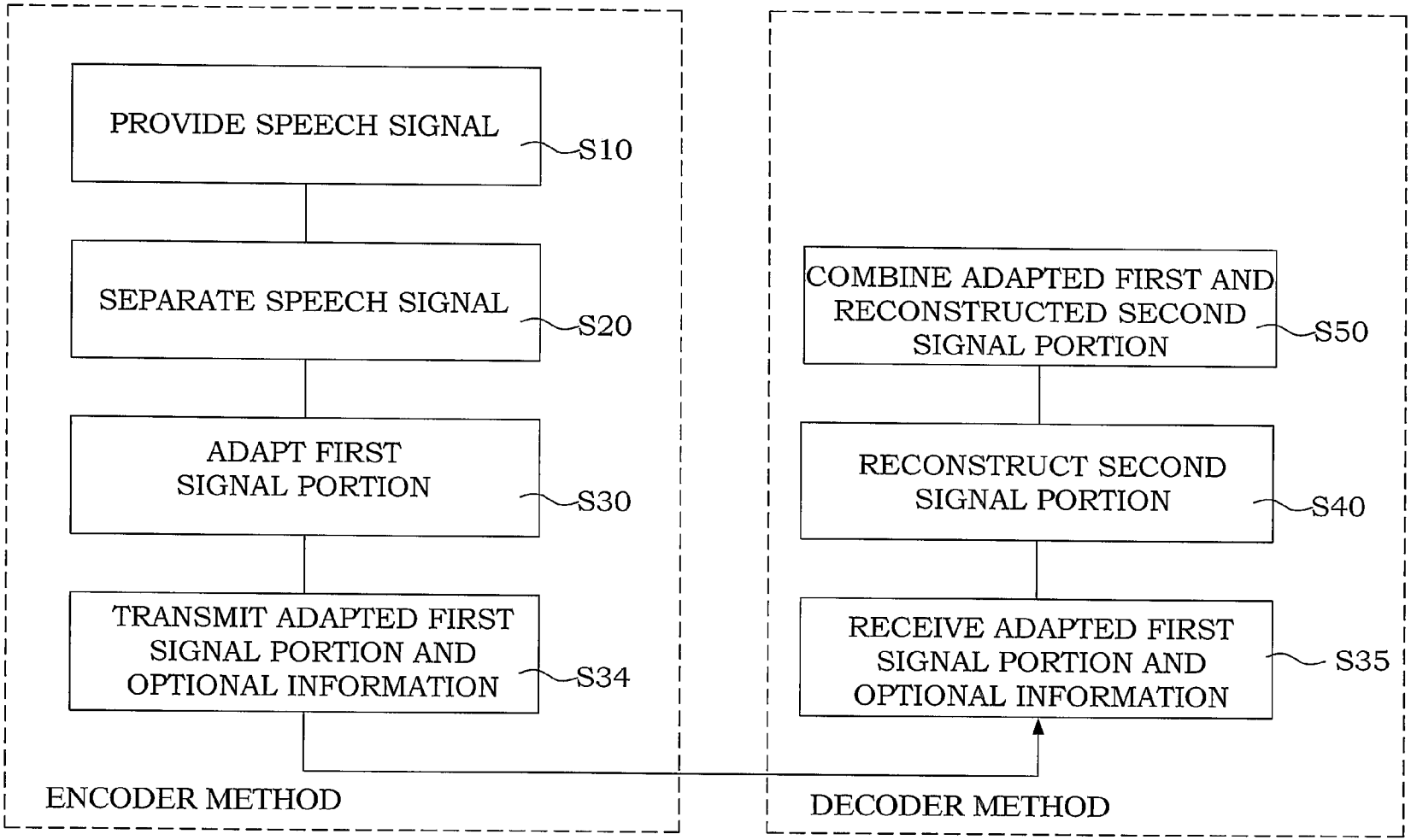
FIG. 4 as a schematic flow chart of yet a further embodiment of a method according to the present invention.

With reference to FIG. 4 an embodiment of a method where the filtering or adaptation of the first signal portion, e.g. the low frequency bands, of the speech signal is performed in an encoder or transmitter arrangement will be described. In this embodiment, also the decoder arrangement needs to be adapted to enable exploiting the full benefits of the invention, which will be described below.

Accordingly, in the encoder or transmitter node or arrangement the steps of providing S10 a speech signal, and separating S20 the speech signal into at least a first and a second signal portion based on a first and second bandwidth portion of a predetermined bandwidth of the speech signal, are performed. Subsequently, the encoder arrangement adapts S30 the provided first signal portion to emphasize a predetermined frequency or frequency interval within the first bandwidth portion. The adapted first signal portion or a representation thereof is then transmitted S34 to and received at S35 a node in the network e.g. a receiver or decoder arrangement. In addition, the encoder provides optional information about what type of codec is used or any other information necessary for the decoder to be able to reconstruct S40 the second signal portion or high frequency bands based on at least the received adapted first signal portion (e.g. low frequency bands). Typically, this assisting information is already made available during session negotiation between the two nodes or known beforehand, wherein the codec and other session parameters are agreed upon. However, for some cases additional assisting information needs to be provided to assist the reconstruction of the second signal portion. Finally, the decoder is able to combine S50 the received adapted first signal portion $LB_f$ and the reconstructed second signal portion HB to provide a reconstructed speech signal with improved overall perceived loudness and sharpness. This is further illustrated in FIG. 5.

Figure 5:
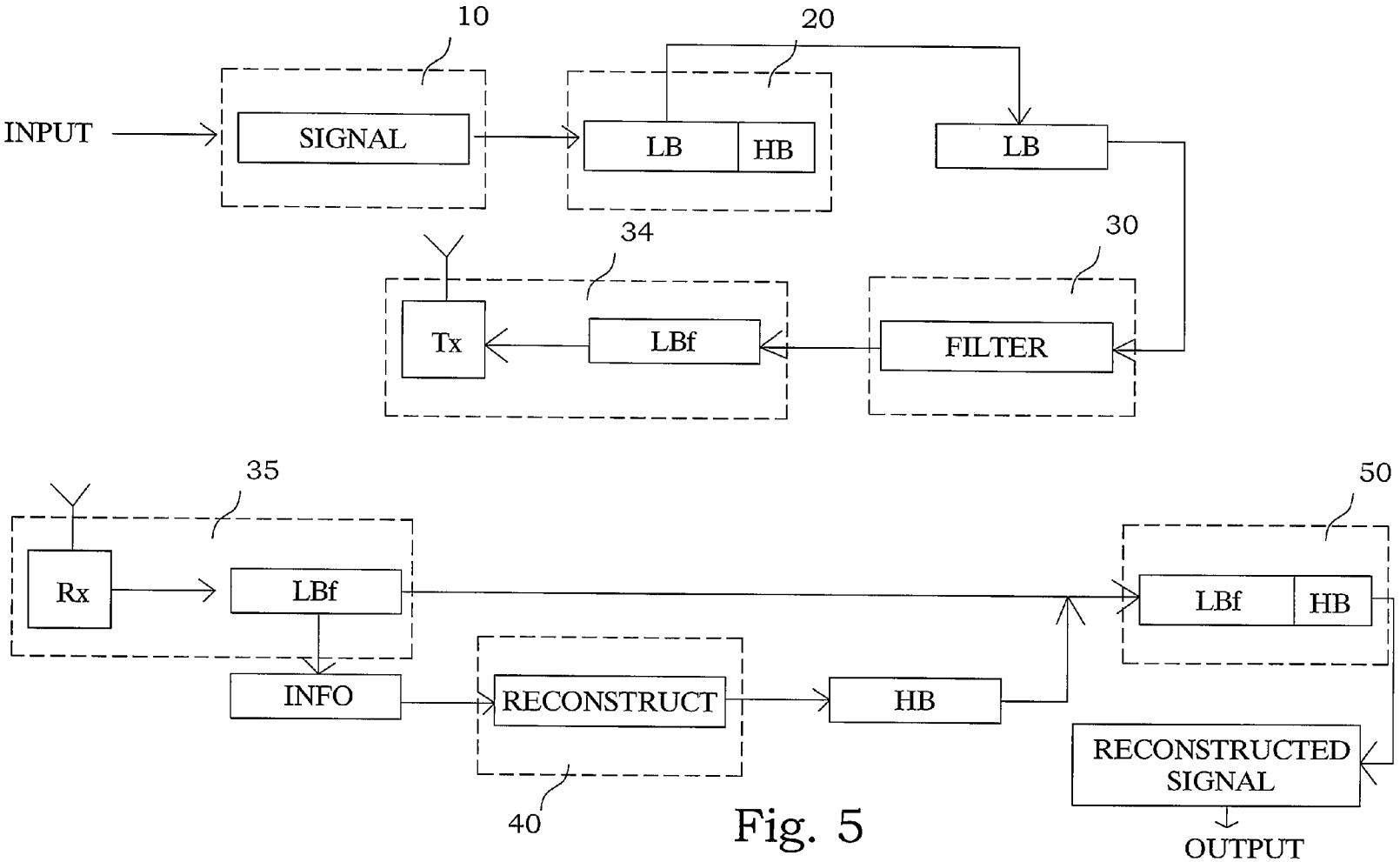
FIG. 5 is a schematic block scheme of the workings of the embodiment of FIG. 4.

With reference to FIG. 5, the various portions of the provided speech signal and their processing during the execution of the described method are shown. Consequently, in FIG. 5 a signal provider 10 provides a speech signal, which signal is subsequently separated by signal separator 20 into a first and second signal portion based on its low frequency bands LB and high frequency bands HB. The first signal portion LB is then adapted or filtered by adaptor 30 to provide a filtered or adapted first signal portion $LB_f$. This is then transmitted by a transmitter 34. Subsequently, the transmitted adapted first signal portion $LB_f$ is received at a receiver 35. Together with this signal, or already during the session initialization or codec negotiation, information enabling reconstruction of the second signal portion HB is provided. Based on the received adapted first signal portion $LB_f$, the second signal portion HB or representation thereof is reconstructed by reconstructor 40 (e.g. preferably using BWE or low-pass filtering). Finally, the two portions $LB_f$ and HB are combined by combiner 50 to form the improver reconstructed or combined speech signal.

Figure 6:
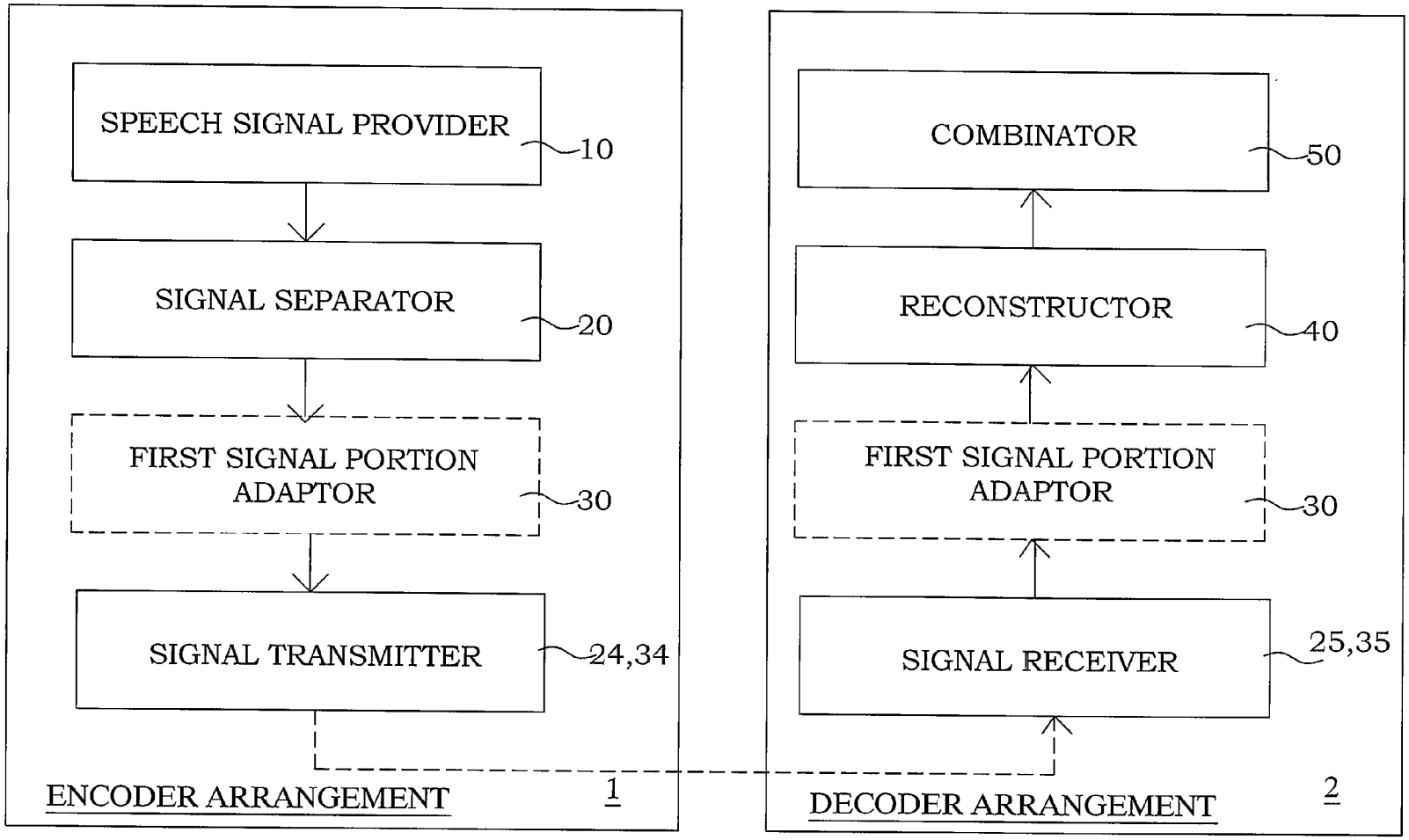
FIG. 6 is a schematic block scheme of embodiments of arrangements according to the present invention.

With reference to FIG. 6, embodiments of a system 100 and arrangements e.g. encoder arrangement 1/decoder arrangement 2, transmitter/receiver, first/second nodes supporting the overall method will be described. In addition, the functionality of the adaptation or filtering of the first signal portion can be provided as a separate functionality, e.g. filter arrangement 30, which can be implemented in either of the encoder arrangement 1 or decoder arrangement 2, or some other node in the system 100, as indicated by the dotted box 30.

An embodiment of a system 100, with reference to FIG. 6, according to the present invention includes a signal provider 10 for providing a speech signal delimited by a predetermined bandwidth. This signal can be provided from another node in the system, or actually registered/generated in an encoder arrangement 1 by means of a microphone or other audio device or in some other arrangement in the system. Further, the system 100 includes a separator 20 for separating the speech signal into at least two signal portions based on two bandwidth portions within the predetermined bandwidth. Typically, the two signal portions correspond to the low frequency bands LB and the high frequency bands HB of the signal, but some other separation could be performed. In addition, the system 100 includes an adaptor 30 for filtering or adapting the first signal portion or LB to emphasize at least a predetermined frequency or frequency interval within the first bandwidth portion. Finally, the system 100 includes a reconstructor 40 for reconstructing the second signal portion or HB of the signal, and a combiner 50 for combining the adapted first signal portion and the reconstructed second signal portion to provide a reconstructed speech signal with improved perceived quality e.g. loudness and sharpness. Also, with reference to FIG. 6, the system 100 comprises two nodes in the communication system, e.g. a first node with an encoder arrangement 1 and a second node with a decoder arrangement 2, embodiments of which will be described below.

According to an embodiment of an encoder 1, the encoder arrangement 1 includes the speech signal provider 10 for providing a speech signal and a signal separator 20 for separating the speech signal into first and second signal portions. In addition, the encoder arrangement 1 includes a first signal portion adaptor 30 for adapting the first signal portion according to previously described methods in this disclosure. Further, the encoder 1 includes a signal transmitter 34 adapted for transmitting at least a representation of the adapted first signal portion and optionally information assisting reconstructing the second signal portion in a decoder arrangement 2 in the system 100.

According to an embodiment of a decoder 2, the decoder arrangement 2 is adapted to cooperate with the previously described encoder arrangement 1. Consequently, the decoder 2 includes a signal receiver 35 for receiving a representation of an adapted first signal portion together with any additional information, the adapted first signal portion being provided by the encoder 1 described above. In addition, the decoder 2 includes a reconstructor 40 for reconstructing a second signal portion of the speech signal based on the received adapted first signal portion. Finally, the decoder 2 includes a combinatory 50 for combining the received adapted first signal portion and the reconstructed second signal portion to provide a reconstructed signal with improved perceived loudness and sharpness.

According to a further embodiment of an encoder 1, the encoder arrangement 1 merely includes a speech signal provider 10 for providing the speech signal, a signal separator 20 for separating the speech signal into a first and second signal portion, and finally a unit 24 for transmitting the first signal portion or at least a representation thereof to a second node in the communication network.

According to a further embodiment of a decoder 2, the decoder arrangement 2 includes a signal receiver 25 for receiving a first signal portion from the above described encoder arrangement 1. In addition, the decoder 2 includes a first signal portion adaptor 30 for adapting or filtering the received first signal portion, a reconstructor 40 for reconstructing a second signal portion based on the received first signal portion and a combiner 50 for combining the adapted first signal portion and the reconstructed second signal portion to provide a reconstructed signal with improved overall perceived loudness and sharpness.

Below will follow some examples of how the adaptation or filtering of the first signal portion can be performed in order to provide the desired emphasis of a predetermined frequency or frequency interval within the first bandwidth portion. These are mere examples, it is evident to the skilled person that the actual mathematical expressions can be modified or expressed differently whilst maintaining the same overall impact on the perceived loudness and sharpness.

The emphasis of middle LB frequencies (typically around 3.2 kHz for a particular embodiment) can be achieved with the following type of filter:

$$H(z)=\alpha\cdot z^{-2}+\beta\cdot z^{-1}-\gamma+\beta\cdot z^{+1}+\alpha\cdot z^{+2} \quad (1)$$

with preferred coefficients $\alpha=0.1$, $\beta=0$ and $\gamma=0.85$

Alternative filter implementation, which affects the tilt of the LB signal:

$$H(z)=\alpha\cdot z^{-1}-\beta+\alpha\cdot z^{+1} \quad (2)$$

with preferred coefficients $\alpha=0.06$ and $\beta=0.66$ or $$H(z)=1-\mu\cdot z^{-1} \quad (3)$$

with preferred coefficient $\mu=0.2$

According to embodiments of the invention, a pre-filtering module is activated to pre-filter the LB part of the signal, if the signal's HB has been reconstructed through BWE scheme, or low-pass filtered. In this context, the term pre-filtering refers to the fact that the filtering is performed prior to reconstructing the speech signal. Thereby only part of the signal is filtered, but the filtering has an effect on the perceived quality of the entire reconstructed signal. The pre-filtering of the embodiments of the present invention aims at emphasizing middle or high-frequencies of the LB.

As previously mentioned, consider a typical LB that consists of frequency components 0 to 6.4 kHz, and a reconstructed HB that consists of frequency components 6.4 to 8 kHz. In that scenario pre-filtering will emphasize frequencies centered around 3.2 kHz, or the entire range 3.2 to 6.4 kHz. The emphasis frequency is typically determined in relation to the outer-middle ear response of a normal hearing test subject, see FIG. 7. However, also other criteria for selecting the emphasis frequency or frequency range can be applied. For example, the adaptation could be tailored based on the actual hearing profile of a customer (disabled or not).

Figure 8:
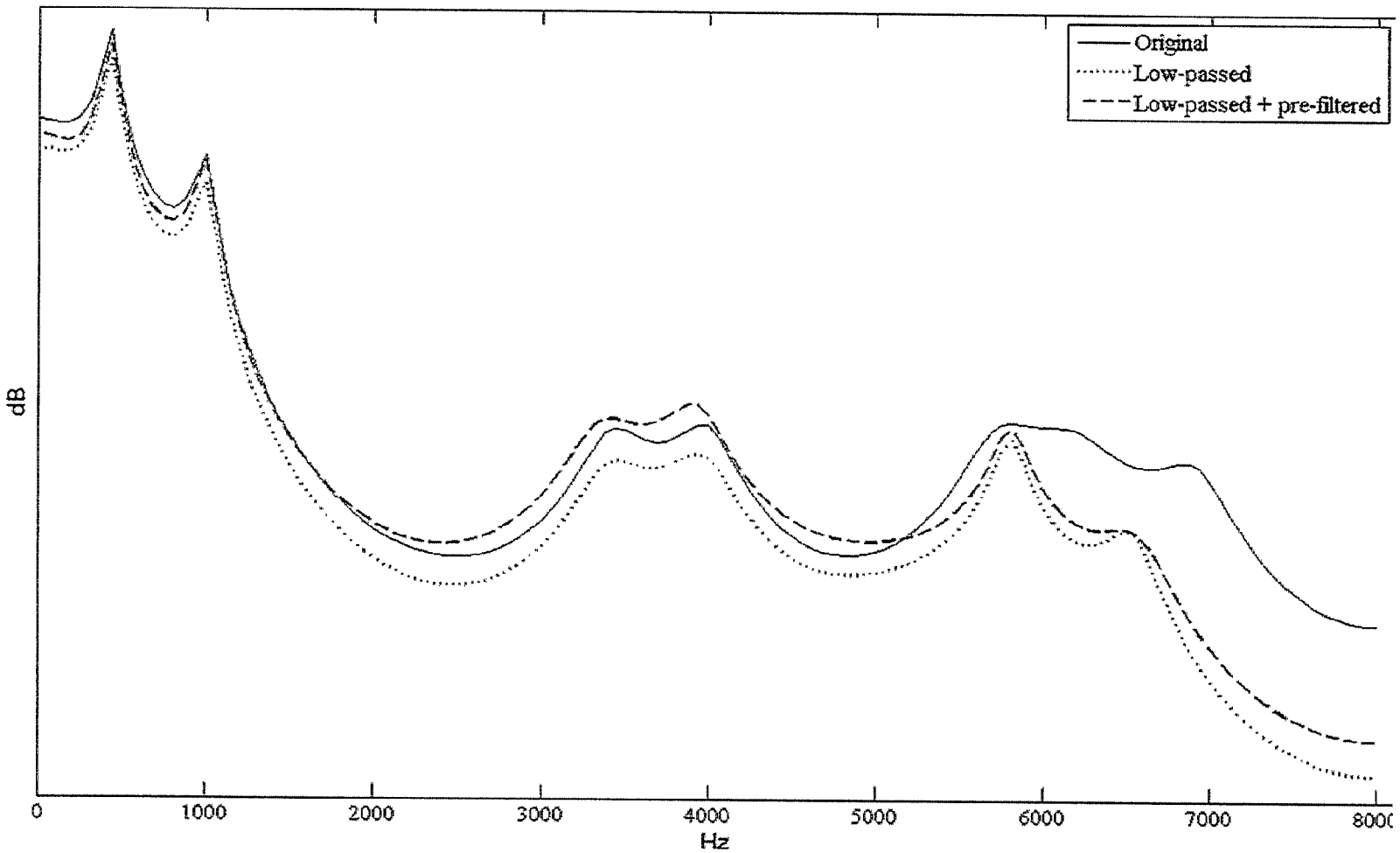
FIG. 8 is a graph illustrating a comparison between prior art and the effect of the present invention.

Illustration of the effect of the invention is presented in FIG. 8. In this example, the solid line shows the original speech signal. The dotted line corresponds to a reconstructed signal that has been subjected to conventional BWE scheme and low pass filtered. Finally, the dashed line corresponds to a reconstructed signal according to the present invention. Both dashed and dotted signals have low energy in the region above 6 kHz, in comparison to the original signal. Despite of that the dashed signal will be perceived as louder and sharper than the dotted signal, due to frequency emphasis in the 3-4 kHz region. In other words, the sharpness and loudness having much energy in high frequencies can be reconstructed by amplifying the LB of the signal instead of the HB: This effectively avoids giving rise to signal artifacts.

To understand how the above pre-filtering affect the sensations or perception of loudness and sharpness (thus improving perceived quality), it is beneficial to look into their respective psychoacoustical models. Let define the specific loudness at critical band k by $\tilde{N}(k)$, then the loudness and sharpness can be defined as [6]:

$$N=\sum_k \tilde{N}(k), \quad (4)$$

$$S \propto \frac{\sum_k k\times f(k)\times \tilde{N}(k)}{\sum_k \tilde{N}(k)}. \quad (5)$$

Figure 7:
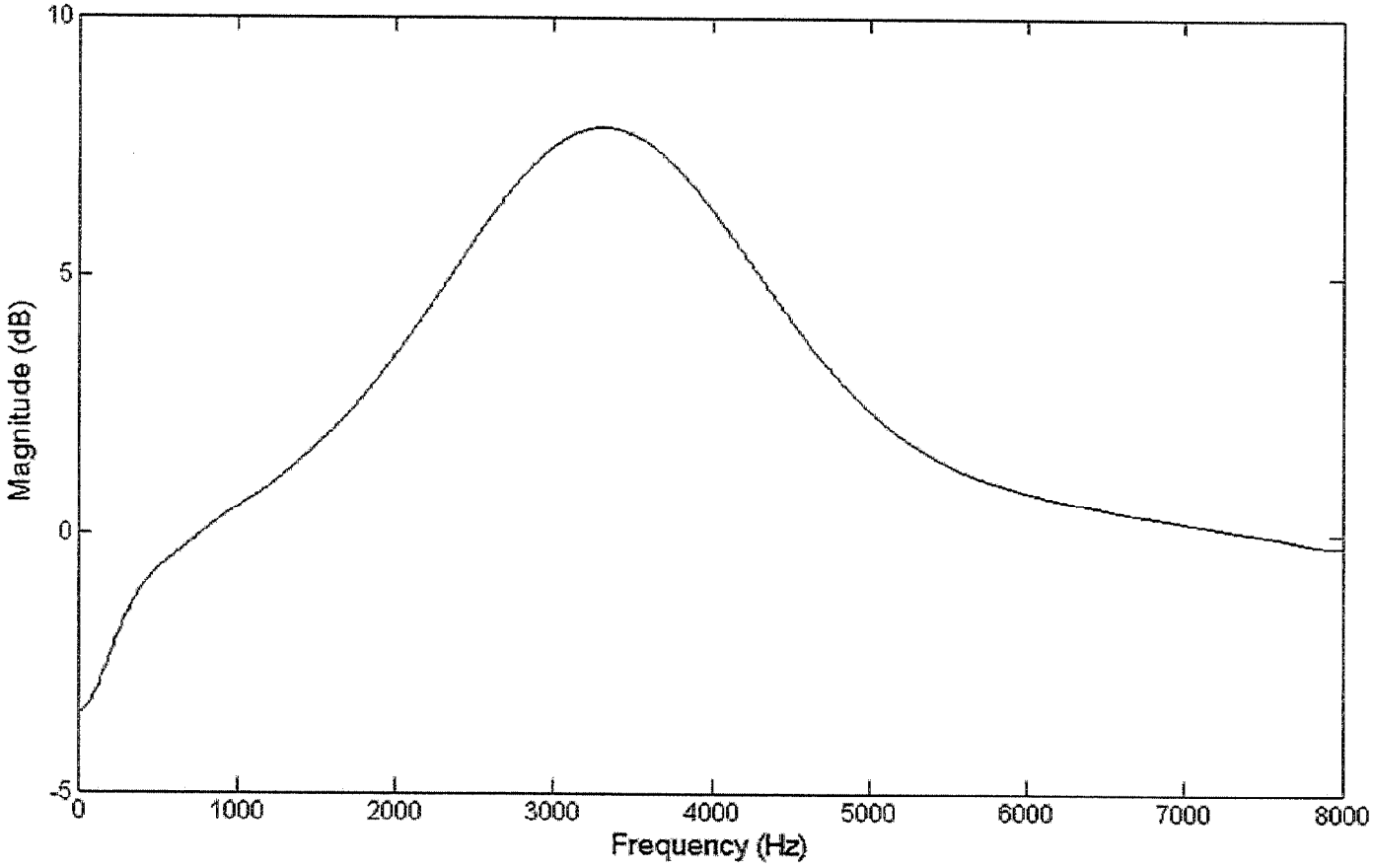
FIG. 7 is a graph illustrating the outer-middle ear response.

The summation is over all critical bands of the bandwidth of the signal, and the function f(k) equals one for the low frequency bands and increases for the last few critical frequency bands. The specific loudness is defined as:

$$\tilde{N}(k)\propto(0.5+0.5\times E(k)\times E^*(k))^{0.23}, \quad (6)$$

where the normalization factor E* can be related to the inverse of threshold in quiet, or outer-middle ear frequency response, see FIG. 7. Excitation E can be calculated by transforming the signal waveform into frequency domain, followed by grouping frequency bins into critical frequency bands.

From equation (4), (6), and FIG. 7 it is possible to conclude that the sensation of loudness can be increased by distributing available signal energy towards the 3.2 kHz region, even if the overall signal intensity is preserved.

From equation (5) it is possible to conclude that the sensation of sharpness can be increased by distributing energy from low towards high frequencies in the LB—higher bands have larger weight in the sum, due to increasing k and f(k).

Figure 9:
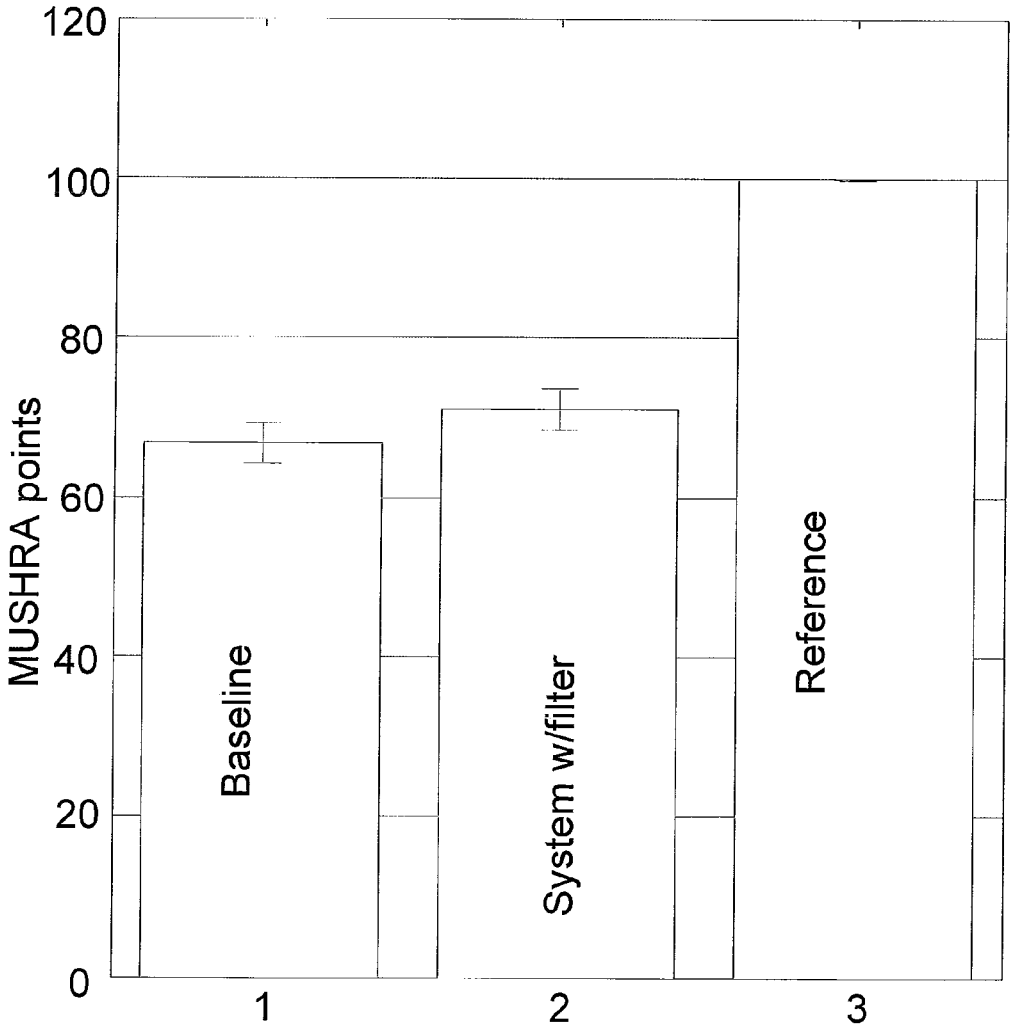
FIG. 9 is a diagram illustrating a comparative listening test between prior art and the effect of the present invention.

The inventors have performed extensive listening tests according to the well-established MUSHRA scheme [7], the results of which are presented in FIG. 9. The white column is the reference signal, the grey column is the result of the present invention, and the black column is a prior art result. As can be seen from the diagram, the adaptation of the signal according to the present invention yields a signal that is closer to the reference signal than prior art methods, thus providing an improved listening experience as compared to prior art.

Figure 10:
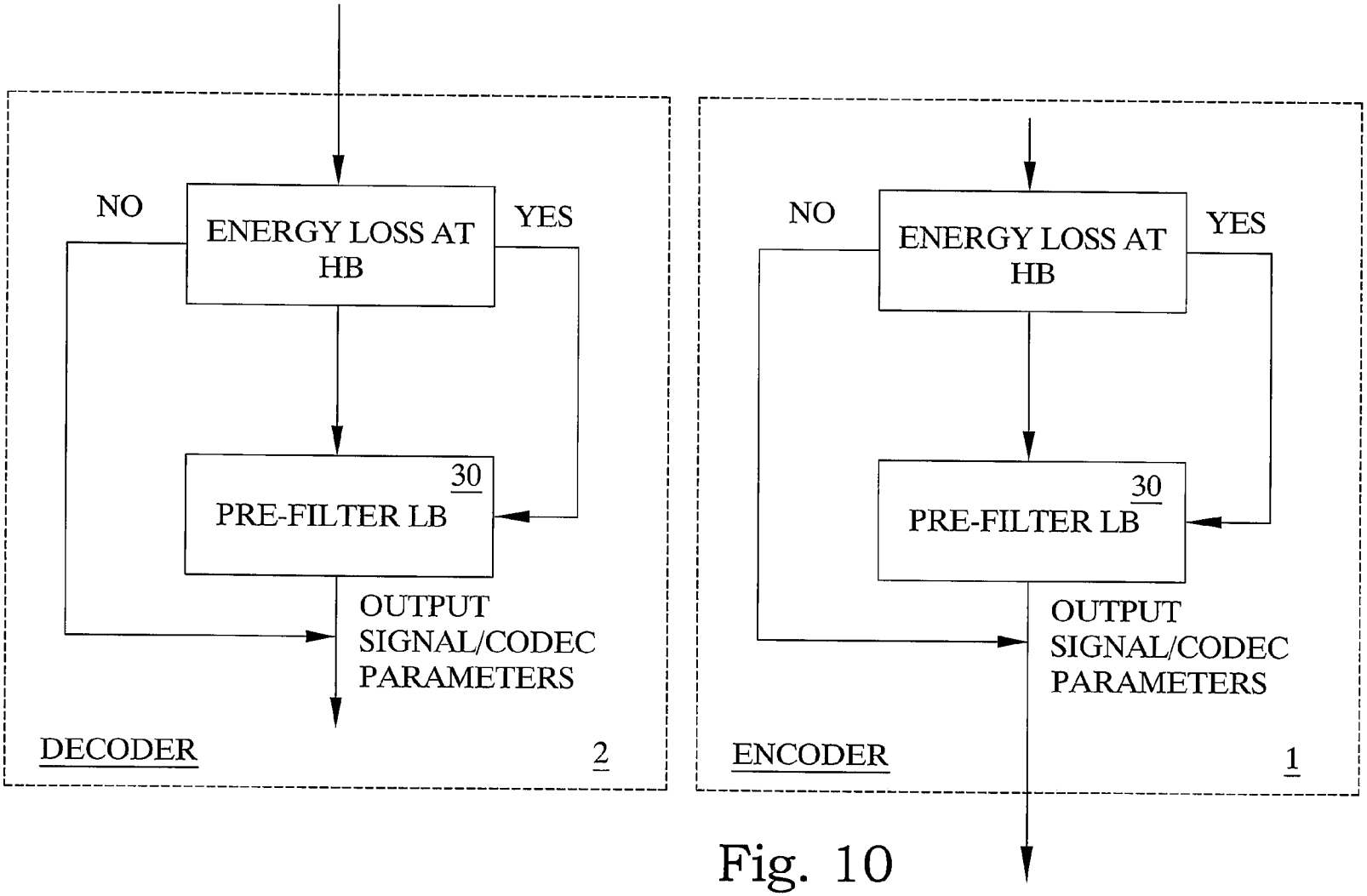
FIG. 10 is a schematic block scheme of further embodiments of arrangements according to the present invention.

Further, FIG. 10 illustrates examples of the functionality of an encoder and a decoder according to the present invention.

The steps, functions, procedures and/or blocks described above may be implemented in hardware using any conventional technology, such as discrete circuit or integrated circuit technology, including both general-purpose electronic circuitry and application-specific circuitry.

Alternatively, at least some of the steps, functions, procedures, and/or blocks described above may be implemented in software for execution by a suitable processing device, such as a micro processor, Digital Signal Processor (DSP) and/or any suitable programmable logic device, such as a Field Programmable Gate Array (FPGA) device.

It should also be understood that it might be possible to re-use the general processing capabilities of the network nodes. For example this may, be performed by reprogramming of the existing software or by adding new software components.

The software may be realized as a computer program product, which is normally carried on a computer-readable medium. The software may thus be loaded into the operating memory of a computer for execution by the processor of the computer. The computer/processor does not have to be dedicated to only execute the above-described steps, functions, procedures, and/or blocks, but may also execute other software tasks.

Figure 11:
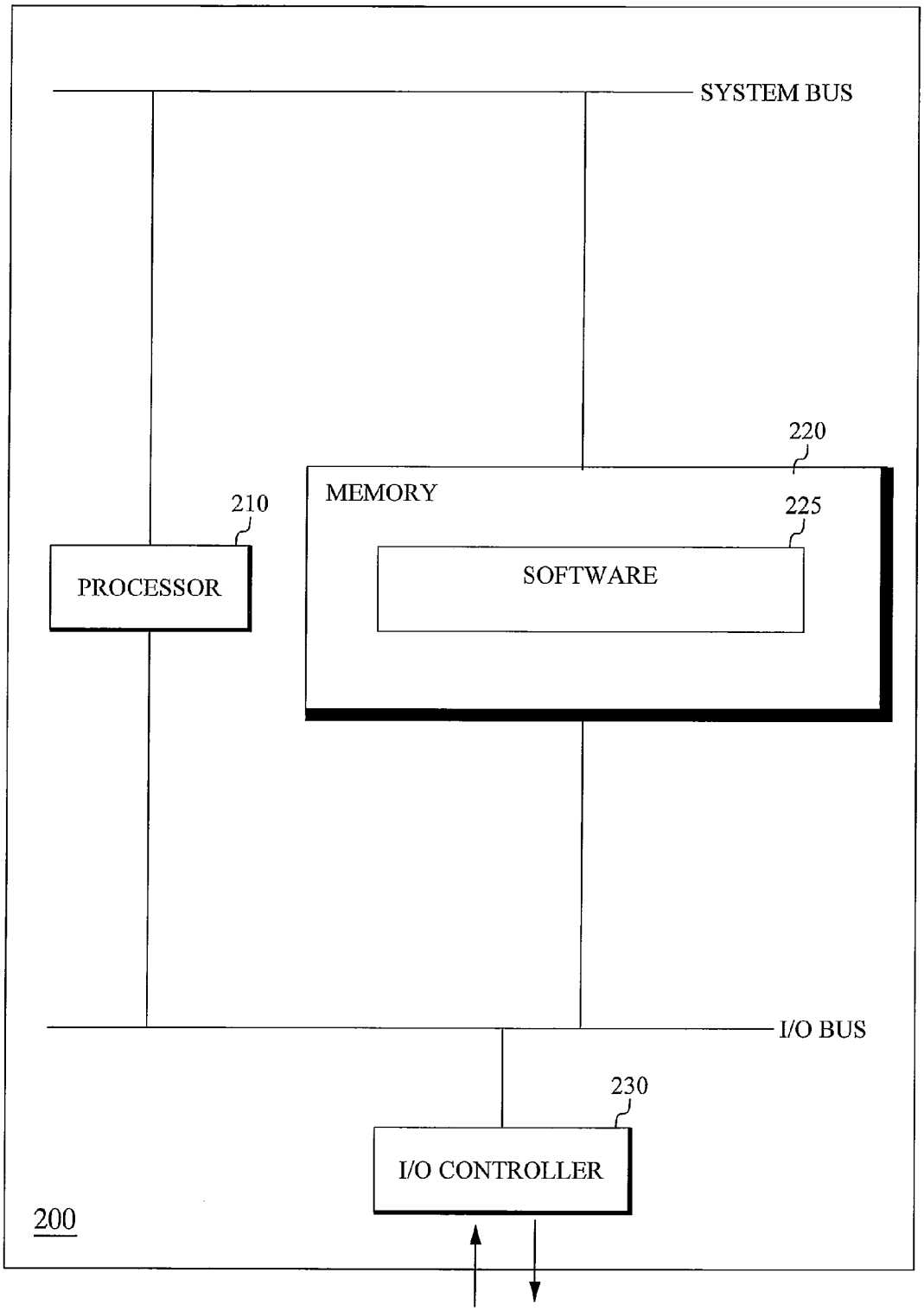
FIG. 11 is a schematic block scheme of an embodiment of the present invention.

In the following, an example of computer-implementation will be described with reference to FIG. 11. A computer 200 comprises a processor 210, an operating memory 220, and an input/output unit 230. In this particular example, at least some of the steps, functions, procedures, and/or blocks described above are implemented in software 225, which is loaded into the operating memory 220 for execution by the processor 210. The processor 210 and memory 220 are interconnected to each other via a system bus to enable normal software execution. The I/O unit 230 may be interconnected to the processor 210 and/or the memory 220 via an I/O bus to enable input and/or output of relevant data such as input parameter(s) and/or resulting output parameter(s).

The proposed scheme for partial loudness and sharpness compensation improves perceptual quality, while preserving bitrate requirements and complexity constraints. The concept is applicable to almost any modern audio codec or BWE scheme. The filtering emphasizes the middle or high frequencies of the LB portion of the signal to improve the sensation of loudness and sharpness for the entire reconstructed signal. In other words, a partial filtering of the signal provides improved perceived quality for the entire signal.

References

[1] 3GPP TS 26.190, "Adaptive Multi-Rate-Wideband (AMR-WB) speech codec; Transcoding functions", 2008

[2] 3GPP TS 26.290 "Extended Adaptive Multi-Rate-Wideband (AMR-WB+) speech codec; Transcoding functions", 2005

[3] 3GPP TS 26.404 "Enhanced aacPlus encoder SBR part", 2007

[4] ITU-T Rec. G.729.1, "G.729-based embedded variable bit-rate coder: An 8-32 kbit/s scalable wideband coder bitstream interoperable with G.729", 2006

[5] ITU-T Rec. G.718, "Frame error robust narrowband and wideband embedded variable bit-rate coding of speech and audio from 8-32 kbit/s", 2008

[6] H. Fastl and E. Zwicker, "Psychoacoustics: Facts and Models," Chapter 8.7.1 and 9.2, Springer, 2007

[7] G. Stoll and F. Kozamernik, "EBU listening tests on Internet audio codecs", EBU Technical Review, June 2000.

The invention claimed is:

1. A method of improving perceived loudness and sharpness of a speech signal delimited by a predetermined bandwidth in a communication system, the method comprising:

separating a speech signal into at least a first signal portion based on a first bandwidth portion of the predetermined bandwidth, and a second signal portion based on a second bandwidth portion of the predetermined bandwidth;

adapting, in a node of the communication system, the first signal portion to emphasize at least a predetermined frequency or frequency interval within the first bandwidth portion;

reconstructing the second signal portion based on at least the first signal portion;

combining the adapted first signal portion and the reconstructed second signal portion to reconstruct the speech signal.

2. The method of claim 1 wherein the adapting comprises filtering the first signal portion, whereby at least part of the energy of the first signal portion is distributed towards a selected frequency in the first bandwidth portion and simultaneously at least another part of the energy of the first signal portion is distributed towards a selected high frequency interval of the first bandwidth portion.

3. The method of claim 2 wherein the filtering is performed according to the following filter function H(z): $H(z)=\alpha\cdot z^{-2}+\beta\cdot z^{-1}-\gamma+\beta\cdot z^{+1}++\cdot z^{+2}$, wherein H(z) is a transform function, z is a complex frequency variable and α, β and γ are constants.

4. The method of claim 3 wherein coefficient α is approximately 0.1, coefficient β is approximately 0, and coefficient Yis approximately 0.85.

5. The method of claim 2 wherein the filtering is performed according to the following filter function H(z): $H(z)=\alpha\cdot z^{-1}-\beta+\alpha\cdot z^{+1}$, wherein H(z) is a transform function, z is a complex frequency variable and αand βare constants.

6. The method of claim 5 wherein coefficient α is approximately 0.06and coefficient β is approximately 0.66.

7. The method of claim 2 wherein the step of filtering is performed according to the following filter function H(z): $H(z)=1-\mu\cdot z^{-1}$, wherein H(z) is a transform function, z is a complex frequency variable and μ is a constant.

8. The method of claim 7 wherein coefficient μ is approximately 0.2.

9. The method of claim 2 further comprising selecting the frequency within the first bandwidth portion based on a natural outer-middle ear response.

10. The method of claim 1 wherein the first bandwidth portion corresponds to low frequency bands of the speech signal, and the second bandwidth portion corresponds to high frequency bands of the speech signal.

11. The method of claim 10:

further comprising pre-filtering low frequency bands prior to the adapting the first signal portion;

wherein the reconstructing the second signal portion is based on bandwidth extension or low pass filtering.

12. A communication system for improving perceived loudness and sharpness of a reconstructed speech signal delimited by a predetermined bandwidth in the communication system, the system comprising:

a signal separator circuit configured to separate a speech signal into at least a first signal portion based on a first bandwidth portion of the predetermined bandwidth, and a second signal portion based on a second bandwidth portion of the predetermined bandwidth;

an adapter circuit configured to adapt the first signal portion to emphasize at least a predetermined frequency or frequency interval within the first bandwidth portion;

a reconstructor circuit configured to reconstruct the second signal portion based on at least the first signal portion;

a combiner circuit configured to combine the adapted first signal portion and the reconstructed second signal portion to reconstruct the speech signal.

13. The system of claim 12:

wherein the adapter circuit is configured to adapt the first signal portion by pre-filtering, where the first signal portion corresponds to low frequency bands of the speech signal;

wherein the reconstructor circuit is configured to reconstruct high frequency bands of the speech signal based on bandwidth extension or low-pass filtering.

14. An encoder for processing a speech signal delimited by a predetermined bandwidth in a communication system so as to enable enhancing a perceived loudness and sharpness of the speech signal, the encoder comprising:

a signal separator circuit configured to separate the speech signal into at least a first signal portion based on a first bandwidth portion of the predetermined bandwidth, and a second signal portion based on a second bandwidth portion of the predetermined bandwidth;

an adapter circuit configured to adapt the first signal portion to emphasize at least a predetermined frequency or frequency interval within the first bandwidth portion;

a transmitter circuit configured to transmit at least the adapted first signal portion to another node.

15. The encoder of claim 14 wherein the adapter circuit is configured to pre-filter low frequency bands of the speech signal.

16. A decoder for processing a speech signal delimited by a predetermined bandwidth in a communication system so as to enable enhancing a perceived loudness and sharpness of the speech signal, the decoder comprising:

a receiver circuit configured to receive an adapted first signal portion, the adapted first signal portion originating from separating a speech signal into at least a first signal portion based on a first bandwidth portion of a predetermined bandwidth and a second signal portion based on a second bandwidth portion of the predetermined bandwidth, and adapting the first signal portion to emphasize at least a predetermined frequency or frequency interval within the first bandwidth portion;

a reconstructor circuit configured to reconstruct the second signal portion based on at least received information related to reconstructing the speech signal and the received adapted first signal portion;

a combiner circuit configured to combine the received adapted first signal portion and the reconstructed second signal portion to provide a reconstructed speech signal.

17. The decoder of claim 16 wherein the adapted first signal portion is a pre-filtered low frequency band signal portion.

18. A decoder for processing a speech signal delimited by a predetermined bandwidth in a communication system so as to enable enhancing a perceived loudness and sharpness of the speech signal, the decoder comprising:

a receiver circuit configured to receive a first signal portion, the first signal portion originating from separating a provided speech signal into at least a first signal portion based on a first bandwidth portion of the predetermined bandwidth and a second signal portion based on a second bandwidth portion of the predetermined bandwidth;

an adapter circuit configured to adapt the received first signal portion to emphasize at least a predetermined frequency or frequency interval within the first bandwidth portion;

a reconstructor circuit configured to reconstruct the second signal portion based on at least the first signal portion;

a combiner circuit configured to combine the adapted first signal portion and the reconstructed second signal portion to provide a reconstructed speech signal.

19. The decoder of claim 18 wherein the adapter circuit is configured to pre-filter a low frequency band signal portion.

20. A method of processing a speech signal delimited by a predetermined bandwidth in an encoder arrangement in a node in a communication system so as to enable enhancing a perceived loudness and sharpness of the speech signal, comprising:

separating, in the node of the communication system, a speech signal into at least a first signal portion based on a first bandwidth portion of the predetermined bandwidth, and a second signal portion based on a second bandwidth portion of the predetermined bandwidth;

adapting the first signal portion to emphasize at least a predetermined frequency or frequency interval within the first bandwidth portion;

transmitting the adapted first signal portion to another node.

21. The method of claim 20:

wherein the first bandwidth portion corresponds to low frequency bands of the speech signal;

wherein the second bandwidth portion corresponds to high frequency bands of the speech signal.

22. The method of claim 21 wherein the adapting comprises pre-filtering the low frequency bands.

23. The method according to claim 20 wherein the node and the another node comprise an encoder and a decoder respectively.

24. A method of processing a speech signal delimited by a predetermined bandwidth in a decoder arrangement in a node in a communication system so as to enable enhancing a perceived loudness and sharpness of the speech signal, comprising:

receiving, at the node in the communication system, an adapted first signal portion from another node, the adapted first signal portion originating from separating a speech signal into at least a first signal portion based on a first bandwidth portion of the predetermined bandwidth and a second signal portion based on a second bandwidth portion of the predetermined bandwidth, and adapting the first signal portion to emphasize at least a predetermined frequency or frequency interval within the first bandwidth portion;

reconstructing the second signal portion based on the received adapted first signal portion;

combining the adapted first signal portion and the reconstructed second signal portion to reconstruct the speech signal.

25. The method of claim 24:

wherein the first bandwidth portion corresponds to low frequency bands of the speech signal;

wherein the second bandwidth portion corresponds to high frequency bands of the speech signal.

26. The method of claim 25:

wherein the adapting is based on pre-filtering of the low frequency bands;

wherein the reconstructing the second signal portion comprises reconstructing the second signal portion based on bandwidth extension or low pass filtering.

27. The method according to claim 24 wherein the node and the another node comprise an encoder and a decoder respectively.

28. A method of processing a speech signal delimited by a predetermined bandwidth in a decoder arrangement in a node in a communication system so as to enable enhancing a perceived loudness and sharpness of the speech signal, comprising:

receiving, from another node in the communication system, a first signal portion of a speech signal, the first signal portion originating from separating the speech signal into at least a first signal portion based on a first bandwidth portion of the predetermined bandwidth and a second signal portion based on a second bandwidth portion of the predetermined bandwidth;

adapting the received first signal portion to emphasize at least a predetermined frequency or frequency interval within the first bandwidth portion;

reconstructing the second signal portion based on at least the first signal portion;

combining the adapted first signal portion and the reconstructed second signal portion to reconstruct the speech signal.

29. The method of claim 28:

wherein the first bandwidth portion corresponds to low frequency bands of the speech signal;

wherein the second bandwidth portion corresponds to high frequency bands of the speech signal.

30. The method of claim 29:

wherein the adapting comprises pre-filtering the low frequency bands;

wherein the reconstructing the second signal portion comprises reconstructing the second signal portion based on bandwidth extension or low pass filtering.

31. The method according to claim 28 wherein the node and the another node comprise an encoder and a decoder respectively.

32. A device for adapting a speech signal delimited by a predetermined bandwidth in a communication system so as to enable enhancing a perceived loudness and sharpness of the speech signal, comprising:

a filter arrangement circuit configured to adapt a first signal portion of a speech signal, the first signal portion being based on a first bandwidth portion of the predetermined bandwidth of the speech signal, to emphasize at least a predetermined frequency or frequency interval within the first bandwidth portion;

wherein the filter arrangement circuit is further configured to filter the first signal portion such that part of the energy of the first signal portion is distributed towards a selected frequency in the first bandwidth portion and simultaneously another part of the energy of the first signal portion is distributed towards a high frequency interval of the first bandwidth portion.

33. The device of claim 32 wherein the first bandwidth portion corresponds to low frequency bands of the speech signal.

34. The device of claim 33 wherein the filter arrangement circuit is configured to pre-filter the low frequency bands.

35. The device of claim 32 wherein the filter arrangement circuit in one or more of: an encoder, a decoder, a node in a communication system.

* * * * *

UNITED STATES PATENT AND TRADEMARK OFFICE

CERTIFICATE OF CORRECTION

PATENT NO. : 9,031,835 B2
APPLICATION NO. : 13/510333
DATED : May 12, 2015
INVENTOR(S) : Grancharov et al.

It is certified that error appears in the above-identified patent and that said Letters Patent is hereby corrected as shown below:

In Column 4, Line 42, delete "as a" and insert -- is a --, therefor.

In Column 11, Lines 58-59, in Claim 3, delete "$H(z)=\alpha.z^{-2}+\beta.z^{-1}-\gamma+\beta.z^{+1}++z^{+2}$," and insert -- $H(z)=\alpha.z^{-2}+\beta.z^{-1}-\gamma+\beta.z^{+1}\alpha.z^{+2}$, --, therefor In Column 11, Line 63, in Claim 4, delete "Y is" and insert -- $\gamma$ is --, therefor.

In Column 11, Line 67, in Claim 5, delete "$\alpha$and $\beta$are" and insert -- $\alpha$ and $\beta$ are --, therefor.

In Column 12, Line 2, in Claim 6, delete "0.06and" and insert -- 0.06 and --, therefor.

Signed and Sealed this
Twenty-third Day of August, 2016

Michelle K. Lee

Michelle K. Lee
*Director of the United States Patent and Trademark Office*